US008210216B2

(12) United States Patent
Ball

(10) Patent No.: US 8,210,216 B2
(45) Date of Patent: Jul. 3, 2012

(54) PAINT SUPPLYING SYSTEM AND APPARATUS

(76) Inventor: Daniel W. Ball, Port Saint Lucie, FL (US)

( * ) Notice: Subject to any disclaimer, the term of this patent is extended or adjusted under 35 U.S.C. 154(b) by 1148 days.

(21) Appl. No.: 12/029,814

(22) Filed: Feb. 12, 2008

(65) Prior Publication Data

US 2009/0199764 A1 Aug. 13, 2009

(51) Int. Cl.
*B65B 3/04* (2006.01)
*A46B 11/06* (2006.01)

(52) U.S. Cl. ..... 141/20.5; 141/98; 141/113; 118/500; 401/119; 401/121; 401/140; 401/289

(58) Field of Classification Search ..... 141/18, 141/20.5, 67, 98, 113; 401/118, 119, 121, 401/123–125, 140, 289; 118/500–501
See application file for complete search history.

(56) References Cited

U.S. PATENT DOCUMENTS 2,095,351 A * 10/1937 Van William ..... 222/175
2,518,751 A * 8/1950 Carlton ..... 222/106
3,203,454 A * 8/1965 Micallef ..... 141/113
3,602,601 A 8/1971 Zenger et al.
3,809,484 A 5/1974 Bradshaw
4,140,410 A 2/1979 Garcia
D280,468 S 9/1985 Miller et al.
4,712,593 A * 12/1987 Zulauf et al. ..... 141/113
D311,995 S 11/1990 Garcia
5,857,795 A 1/1999 Liou
6,394,152 B1 * 5/2002 Martin ..... 141/351
7,011,468 B1 3/2006 Leventhal
7,037,018 B1 5/2006 Shai
2005/0226680 A1 * 10/2005 Lawrence ..... 401/289
2009/0107579 A1 * 4/2009 Smith et al. ..... 141/67

* cited by examiner

*Primary Examiner* — Gregory Huson
*Assistant Examiner* — Nicolas A Arnett
(74) *Attorney, Agent, or Firm* — Maxey Law Office, PLLC; Stephen Lewellyn; Stephanus Yang

(57) ABSTRACT

A paint supplying system and apparatus for delivering paint to a container system from a supply of paint at a remote location by a paint delivery system to permit application of the paint delivered to the container by a separate coating implement is provided. The container system includes a vessel having a bottom and a peripheral side wall, the peripheral side wall and the bottom define an open interior space. A connector includes a body with opposed first and second ends, a first port on the first end, a second port on the second end, and a through passage connecting the first and second ports, the body being attached at the first end to the bottom such that the first port is in fluid communication with the open interior space, and connectable at the second end to the hand wand such that the second port is in fluid communication with the supply passage.

9 Claims, 6 Drawing Sheets

PAINT SUPPLYING SYSTEM AND APPARATUS

FIELD OF THE INVENTION

The present invention relates generally to the delivery of fluid coatings to a remote location for the application to a surface. More particularly, relating to a system for the delivery of paint to a container from a remote supply of paint to permit application of the paint delivered to the container by a separate coating implement, such as a brush.

BACKGROUND

In recent years, numerous devices have been devised to provide a continuous supply of paint to a paint roller from a remote supply of paint to permit continual application of the paint to a surface without requiring the removal of the paint roller from the surface to apply paint to the roller for application. Examples of such systems are described in U.S. Pat. Nos. 4,140,410; 3,602,601; and 3,809,484, the entirety of each are incorporated herein by reference. These devices include a means, such as a pump, to provide a continuous supply of paint from the paint supply under low pressure through a supply hose to the paint roller. The paint roller is designed to evenly distribute the paint across the roller for application to the surface. While these devices are useful in quickly coating large surface areas, they tend not to be very useful for applying paint to edges of adjacent surfaces, such as for example along the joining edge of a wall and ceiling, for applying paint to trim work or other small surface areas, such as for example the trimming around a doorway or window. This is the case, because during use, the paint roller is attached to the supply hose which makes difficult the necessary manipulation of the paint roller to apply paint in these trouble areas without the supply hose becoming an obstruction or contacting wet paint on surround surfaces.

Heretofore, to apply paint to these trouble areas a limited quantity of paint is poured into a small container into which a hand held brush is dipped for coating the bristles thereof for application of the paint to a surface. It is believed, using a hand held brush is the preferred way of coating these small surfaces to provided a very finished looked. However, the paint in the small container is quickly used requiring the painter to stop painting in order to refill the container.

Accordingly, there is a need for the delivery of paint to a container from a remote supply of paint to permit application of the paint delivered to the container by a separate coating implement, such as a brush.

SUMMARY OF THE INVENTION

The preferred embodiments of the present invention addresses this need by providing a paint supplying system and apparatus for delivering paint to a container from a supply of paint at a remote location to permit application of the paint delivered to the container by a separate coating implement.

The preferred embodiments of the present invention also provide a paint supplying system and apparatus for delivering paint to a container from a supply of paint at a remote location where excess paint delivered to the container can be stored for later use.

The preferred embodiments of the present invention also provide a paint supplying system and apparatus for delivering paint to a container from a supply of paint at a remote location where the container is easily detachable from the system for storage or for use separate from the system.

The preferred embodiments of the present invention also provide a paint supplying system and apparatus for delivering paint to a container from a supply of paint at a remote location where multiple containers can be stacked for storage.

To achieve these and other advantages, in general, in one aspect, a paint container system is attachable to a remote paint delivery system including a hand wand having a supply passage and a supply hose connected to deliver paint from the remote paint delivery system to the supply passage of the hand wand for dispensing is provided. The system includes a vessel having a bottom and a peripheral side wall, the peripheral side wall and the bottom defining an open interior space; and a connector having a body with opposed first and second ends, a first port on the first end, a second port on the second end, and a through passage connecting the first and second ports, the body being attached at the first end to the bottom such that the first port is in fluid communication with the open interior space, and connectable at the second end to the hand wand such that the second port is in fluid communication with the supply passage, whereby paint from the remote paint delivery system is dispensed from the hand wand into the open interior space to be transferred by a coating implement to a surface to be coated.

In general, in another aspect, the system may further include a first cover, the peripheral wall including opposed first and second ends, and wherein the first cover is removably attachable to the first end of the peripheral wall.

In general, in another aspect, the bottom may be removably attachable to the second end of the peripheral wall.

In general, in another aspect, the system may further include a second cover removably attachable to the second end.

In general, in another aspect, the first cover and the second cover may be mutually engagable, whereby two or more container systems may be vertically stacked by engaging a first cover of the first container system with the second cover of a second container system.

In general, in another aspect, a paint supplying system and apparatus for delivering paint to a remote location is provided. The system includes pressure means for supplying paint under pressure; a hand wand having a supply passage; a supply hose connecting the supply passage of the hand wand to the pressure means; a container having a bottom and a peripheral side wall, the peripheral side wall and the bottom defining an open interior space; and a connector having a body with opposed first and second ends, a first port on the first end, a second port on the second end, and a through passage connecting the first and second ports, the body being attached at the first end to the bottom such that the first port is in fluid communication with the open interior space, and connectable at the second end to the hand wand such that the second port is in fluid communication with the supply passage, whereby paint from the remote paint delivery system is dispensed from the hand wand into the open interior space to be transferred by a coating implement to a surface to be coated.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Reference will now be made in detail to the preferred embodiments of the present invention, examples of which are illustrated in the accompanying drawings.

Figure 1:
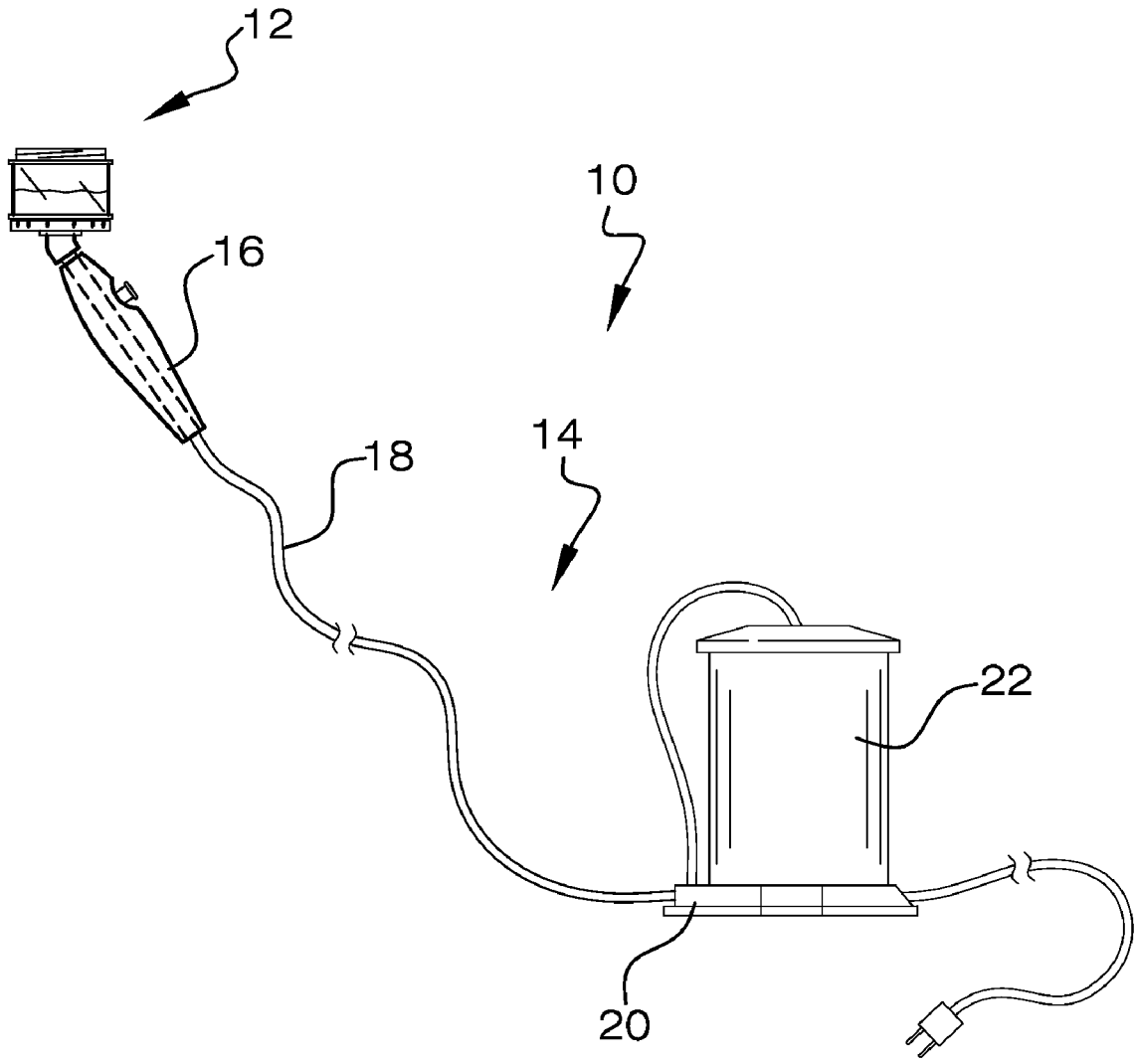
FIG. 1 is a diagrammatic view of the paint supply system constructed in accordance with the principles of the present invention.

Referring now to the drawings, reference numeral 10 generally designates paint supply system of the present invention. With particular reference to FIG. 1, the system 10 includes a container system generally 12 that is removably connectable to a paint delivery system 14. The paint delivery system 14 generally includes a hand wand 16, a supply hose 18, and pressure means 20 for supplying paint under pressure to the supply hose 18. The pressure means 20 may be a pump. The container system 12 is connected to one end of the hand wand 16, and the supply hose 18 connects the other end of the hand wand to the pump 20. The inlet of the pump 20 receives paint from the supply bucket 22 and discharges it at low pressure at its outlet port into the supply hose 18 where it is pumped to the hand wand 16 for dispensing to the container system 12.

Figure 2:
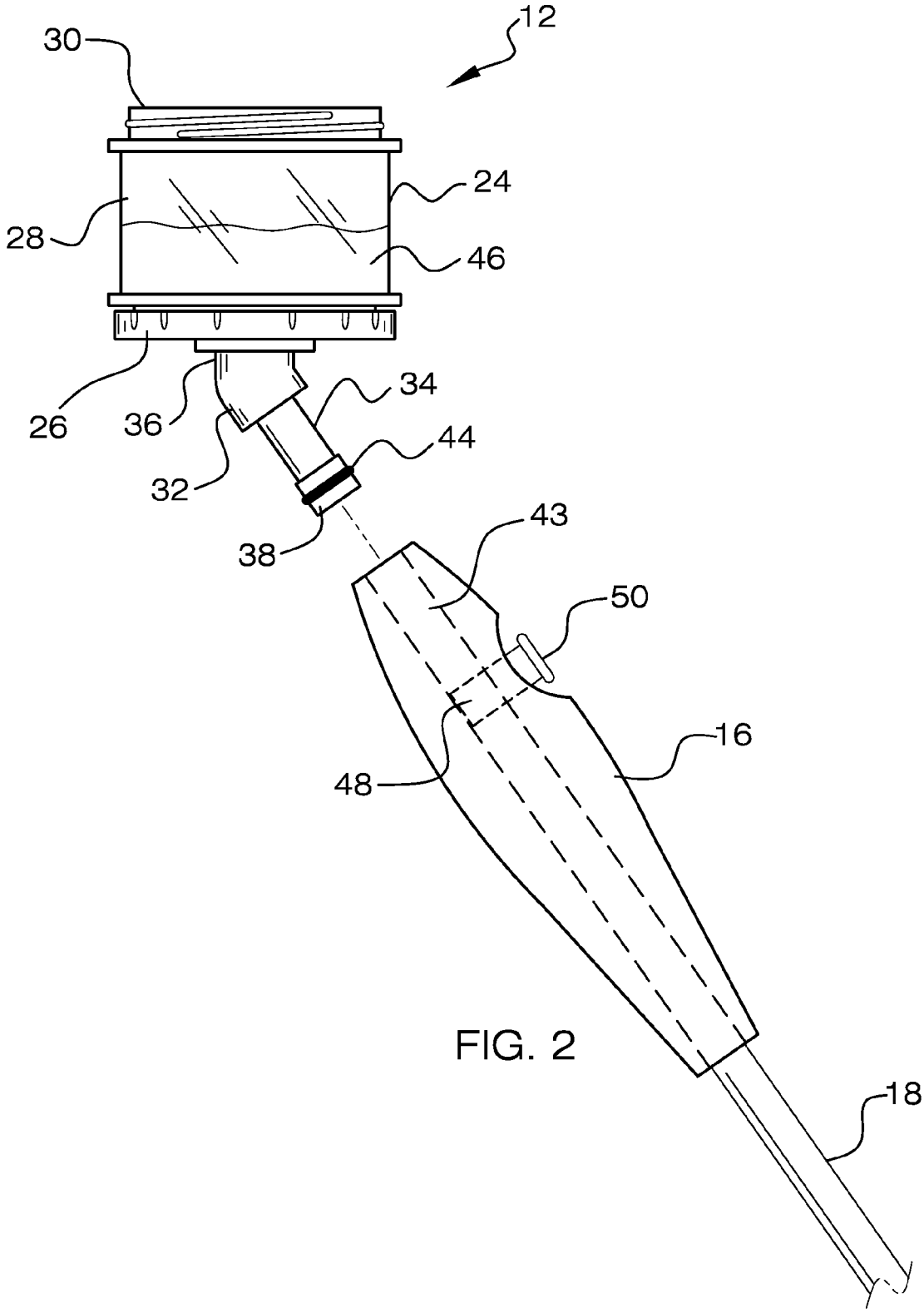
FIG. 2 is a side elevation view of the container system and hand wand of the paint supply system showing the container system detached from the end of the hand wand.
Figure 3:
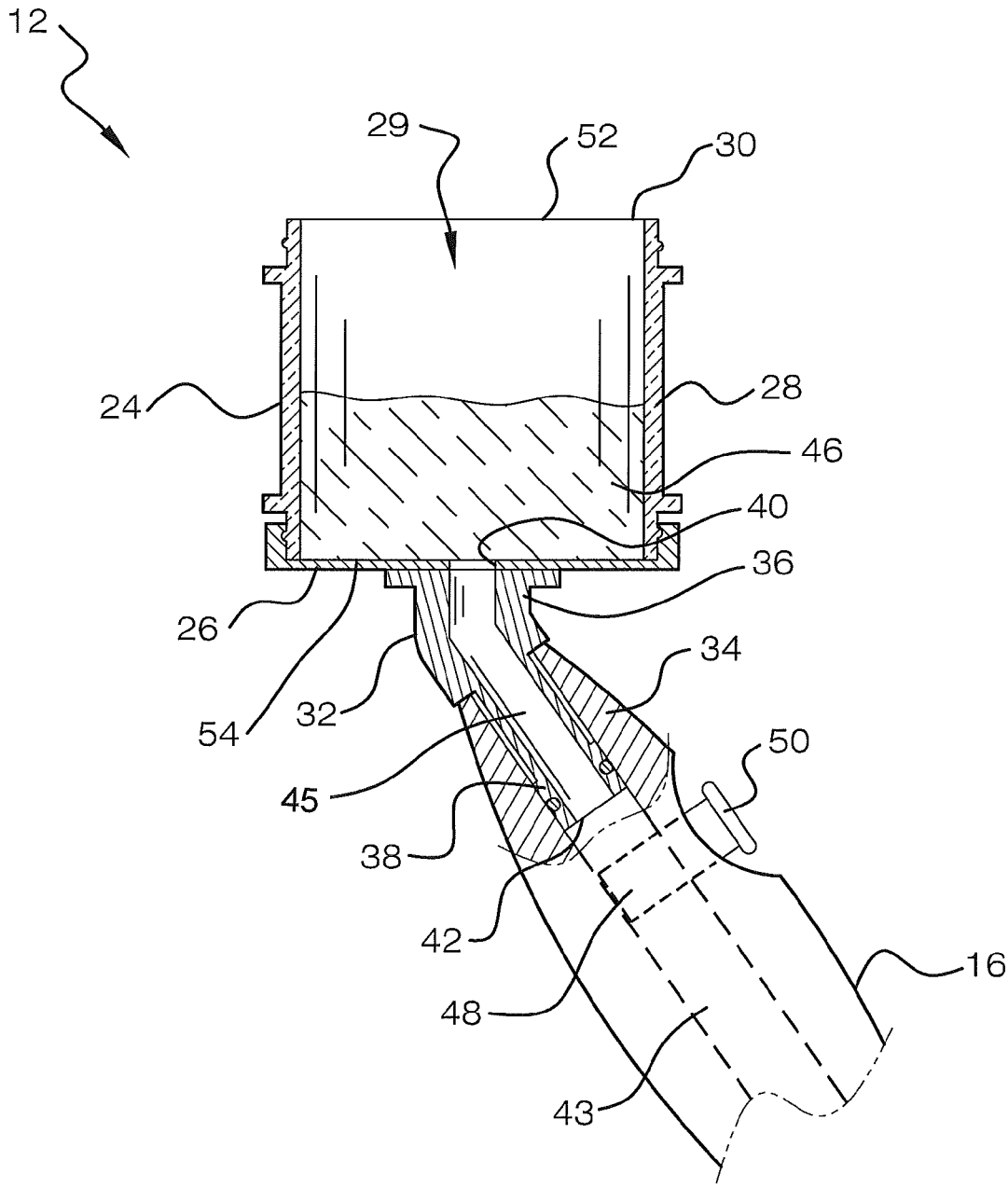
FIG. 3 is an side partial sectional view of the container system.
Figure 4:
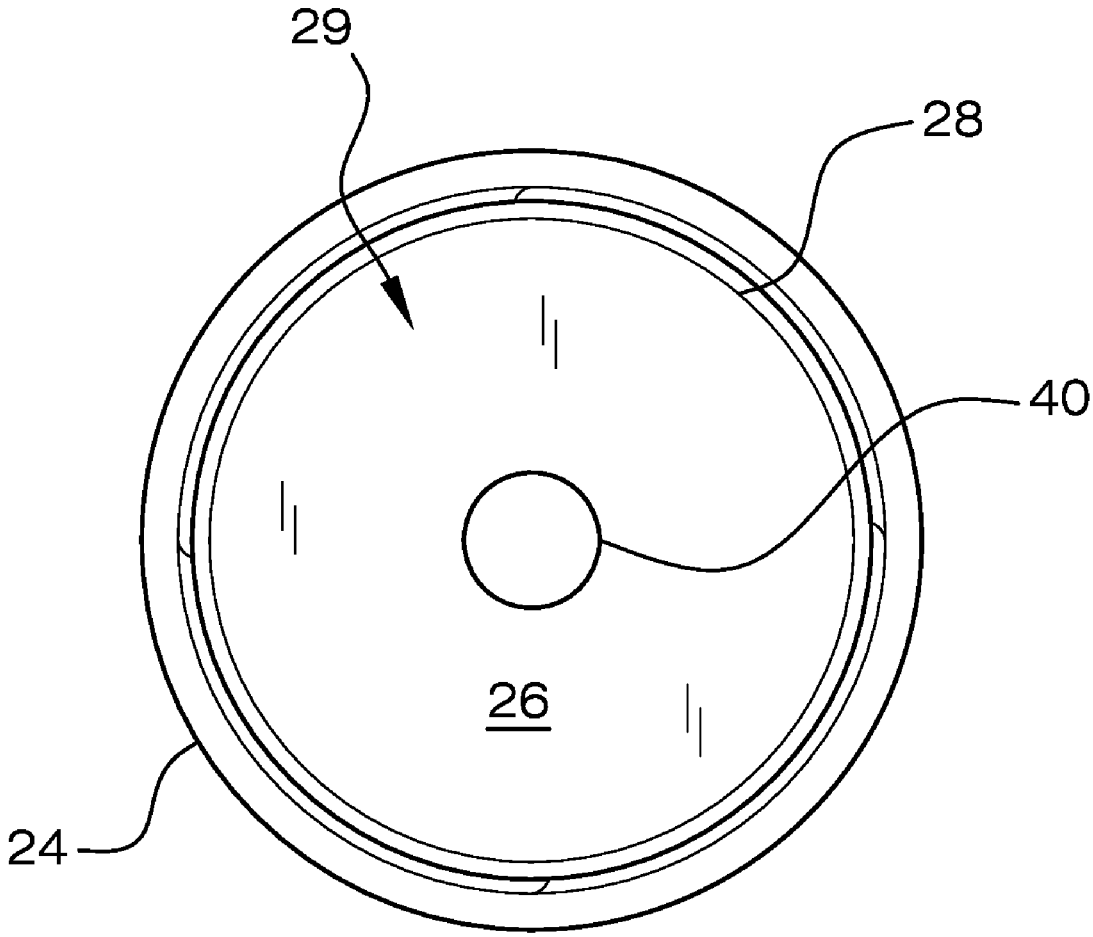
FIG. 4 is a top plan view of the vessel of the container system.

With reference now to FIGS. 2, 3 and 4, the container system 12 includes a vessel 24 having a bottom 26, a peripheral side wall 28, an opening interior space 29 bounded by the bottom and the sidewall, and an open top 30 permitting access from the top into the open interior space. A connector 32 for removably connecting the vessel 24 to the hand wand 16 extends in a direction downward from the bottom 26. The connector 32 includes a body 34 having opposed first and second ends 36 and 38, a first port 40 foamed through the first end, a second port 42 formed through the second end, and a fluid passage 45 connecting the first and second ports. The first end 36 of the body 34 is connected to the bottom 36 with the first port 40 in fluid communication with the open interior space 29. The second end 38 of the body 34 is removably connectable to the hand wand 16 at one end thereof with the second port 38 in fluid communication with a supply passage 43 that is formed through the hand wand to which the supply hose 18 is connected at the opposite end. The body 34 of the connector 32 may be inserted into the supply passage 43 to facilitate the connection therewith. An o-ring seal 44 may be included for providing a sealing contact between the body and the inner surface of the supply passage 43.

Figure 5:
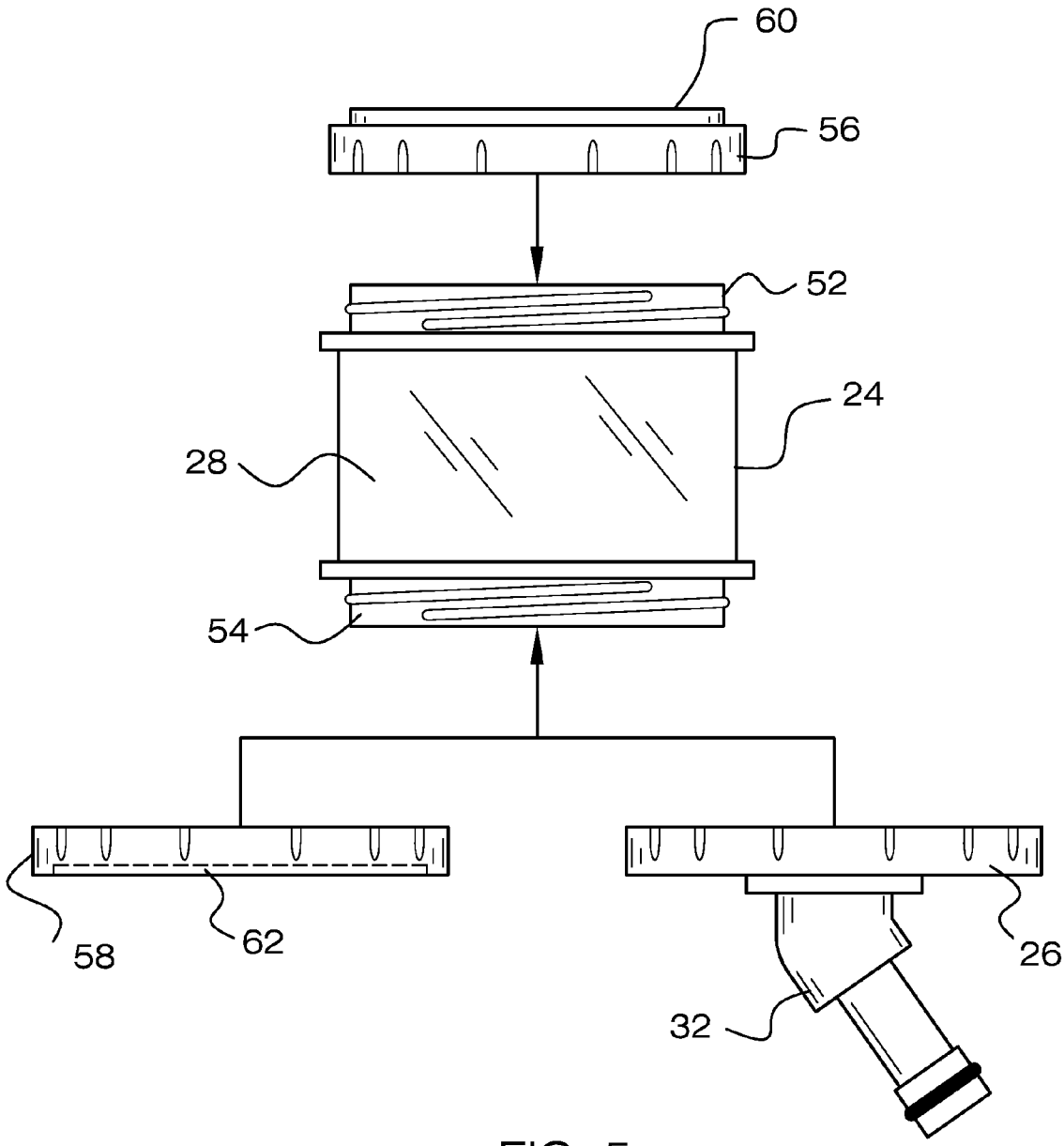
FIG. 5 is a side view of the container system showing the different cover arrangements and the bottom removed from the vessel.

With continued reference to FIGS. 2 and 3, and further reference to FIG. 5, the peripheral wall 28 of the vessel 24 may include opposed first and second ends 52 and 54. A first cover 56 may be provided that is removably attachable to the first end 52 of the vessel 24 to cover the open top 30. The bottom 26 may also be removably attached to the second end 54 of the vessel 24. A second cover 58 may be provided that is removably attachable to the second end 54 of the vessel 24 to replace the bottom 26 once it has been removed. The first cover 56, the bottom 26, and the second cover 58 may be secured to the ends 52 and 54 respectively by either a snap fitment, by a threaded coupling as shown, or in any other manner that provides a tight and secure fitment.

In use, it can now be understood, the vessel 24 of the container system 12 is connected to the hand wand 16 by inserting the body 34 of the connector 32 through the end of the hand wand into the supply passage 43. With the vessel 24 connected to the hand wand 16 paint 46 from the paint supply bucket 22 may be delivered to the open interior space 29 of the vessel 24 under low pressure by the pump 20. The amount of paint 46 delivered to the vessel 24 may be controlled by a normally closed valve 48 positioned within the supply passage 42 of the hand wand 16 that is operable by a button 50. To deliver paint 46 to the vessel 24 the button 50 is pressed, thereby opening the valve 48 and permitting paint to flow through the supply passage 42 and into the vessel 24. Once paint 46 has been dispensed or delivered to the vessel 24 it may be applied to a surface by a brush or the like.

Excess paint 46 that is delivered to the vessel 24 and not used, may be stored within the vessel for later use. To store the excess paint 46, the container system 12 is decoupled from the paint delivery system 14 by disconnecting the vessel 24 from the hand wand 16. The first cover 56 is then attached to end 52 of the of the vessel 24, which is then turned upside down such that the bottom 26 is facing upwards to allow the paint 46 to flow away from the bottom. Once the paint 46 flows away from the bottom 26, the bottom 26 is removed from the vessel 24 and is replaced by the second cover 58. With both the first and second covers 56 and 58 attached to the vessel 24, the paint 46 contained therein, may be stored for later use.

Figure 6:
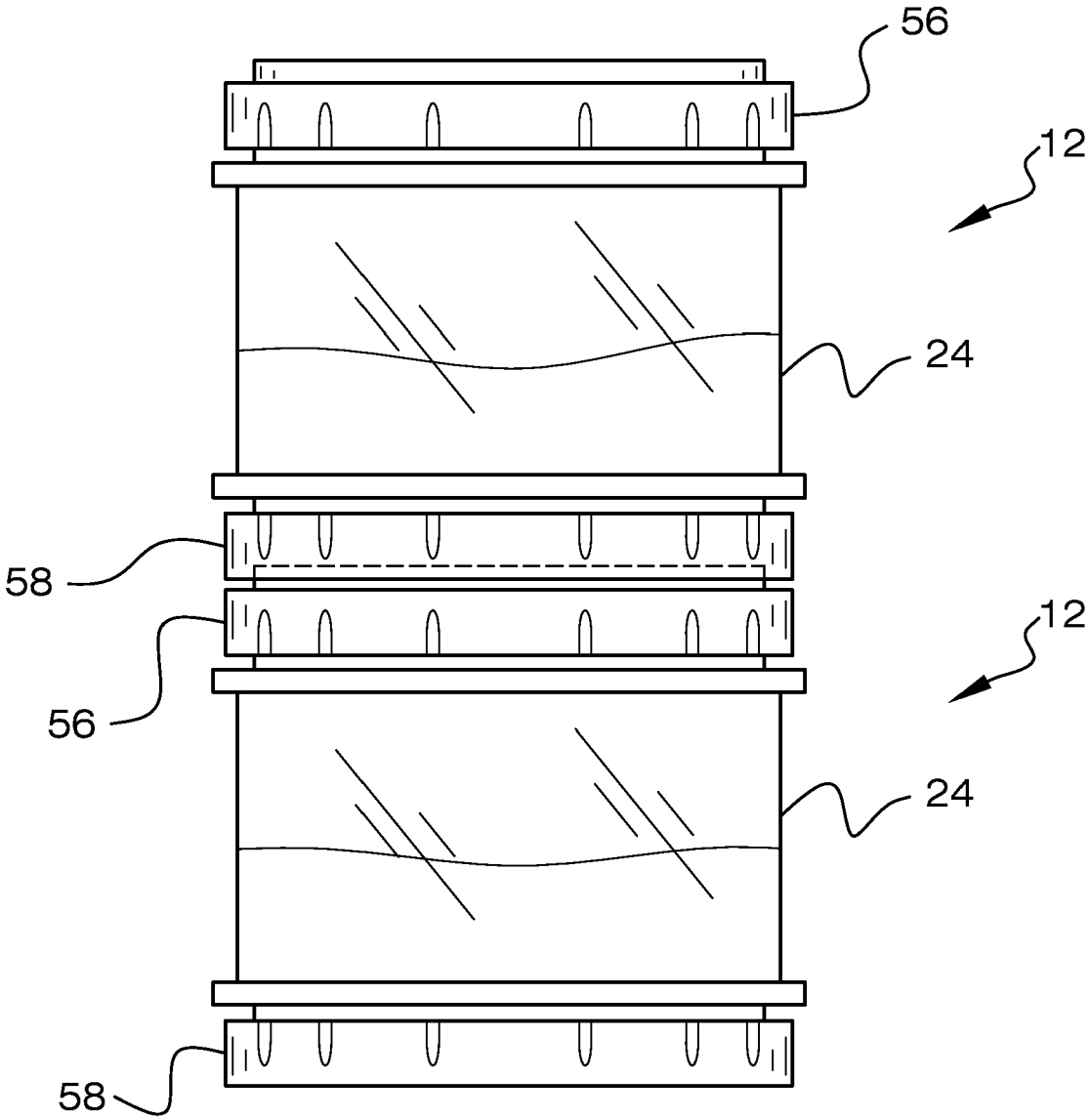
FIG. 6 is a side elevation view showing multiple container systems stacked vertically with the cover of one container system engaged with the cover a second container system.

With reference to FIGS. 5 and 6, the first cover 56 and the second cover 58 may be mutually engagable so that multiple container systems 12 may be stacked together by engaging the first cover of one system with the second cover of another. The first cover 56 may include a peripheral flange 60 extending from an outward facing surface thereof at an inward spaced distance from the peripheral edge of the first cover. The second cover 58 may include a corresponding peripheral recess or grove 62 on an outward facing surface thereof at an inward spaced distance from the peripheral edge of the second cover. To stack multiple container systems 12 together, the peripheral flange 60 of the first cover 56 of one container system 12 may be received by the peripheral recess 62 of the second cover 58 of a second container system 12.

A number of embodiments of the present invention have been described. Nevertheless, it will be understood that various modifications may be made without departing from the spirit and scope of the invention. Accordingly, other embodiments are within the scope of the following claims.

What is claimed is:

1. A paint container system attachable to a remote paint delivery system including a hand wand having a supply passage and a supply hose connected to deliver paint from the remote paint delivery system to the supply passage of the hand wand for dispensing, the paint container system comprising:

a vessel having a bottom and a peripheral side wall, said peripheral side wall and said bottom defining an open interior space; and a connector having a body with opposed first and second ends, a first port on said first end, a second port on said second end, and a fluid passage connecting said first and second ports, said body being attached at said first end to said bottom such that said first port is in fluid communication with said open interior space, and connectable at said second end to the hand wand such that said second port is in fluid communication with the supply passage, whereby paint from the remote paint delivery system is dispensed from the hand wand into the open interior space to be transferred by a coating implement to a surface to be coated;

a first cover, wherein said first cover is removably attachable to said first end of said peripheral wall;

said peripheral wall including opposed first and second ends;

said bottom being removably attachable to said second end of said peripheral wall; and a second cover removably attachable to said second end.

2. The paint container system of claim 1, wherein said first cover and said second cover are mutually engagable, whereby two or more container systems may be vertically stacked by engaging a first cover of the first container system with the second cover of a second container system.

3. A paint supplying system for delivering paint to a remote location, comprising:

pressure means for supplying paint under pressure;

a hand wand having a supply passage;

a supply hose connecting said supply passage of said hand wand to said pressure means;

a vessel having a bottom and a peripheral side wall, said peripheral side wall and said bottom defining an open interior space; and a connector having a body with opposed first and second ends, a first port on said first end, a second port on said second end, and a through passage connecting said first and second ports, said body being attached at said first end to said bottom such that said first port is in fluid communication with said open interior space, and connectable at said second end to said hand wand such that said second port is in fluid communication with said supply passage, whereby paint from the remote paint delivery system is dispensed from the hand wand into the open interior space to be transferred by a coating implement to a surface to be coated.

4. The system of claim 3, further comprising:

a first cover;

said peripheral wall including opposed first and second ends; and wherein said first cover is removably attachable to said first end of said peripheral wall.

5. The system of claim 4, wherein said bottom is removably attachable to said second end of said peripheral wall.

6. The system of claim 5, further comprising:

a second cover removably attachable to said second end.

7. The system of claim 6, wherein said first cover and said second cover are mutually engagable, whereby two or more container systems may be vertically stacked by engaging a first cover of the first container system with the second cover of a second container system.

8. The system of claim 3, wherein said pressure means includes a pump including an inlet port connectable to a supply of paint, and a discharge port connected, wherein said supply hose is connected to said discharge port.

9. The system of claim 3, further comprising:

a valve positioned in said supply passage, said valve operable to prohibit and permit fluid flow in said supply passage, thereby effecting dispensing of paint into said open interior space.

* * * * *